United States Patent [19]

Moeck et al.

[11] Patent Number: 4,971,470

[45] Date of Patent: Nov. 20, 1990

[54] APPLICATOR DEVICE FOR A VISCOUS MATERIAL

[75] Inventors: Gerhard Moeck, Kirchehrenbach; Georg Roeder, Schwabach, both of Fed. Rep. of Germany

[73] Assignee: Schwan-Stabilo Schwanhausser Gmbh & Co., Nuremberg, Fed. Rep. of Germany

[21] Appl. No.: 361,248

[22] Filed: Jun. 5, 1989

[30] Foreign Application Priority Data

Jun. 14, 1988 [DE] Fed. Rep. of Germany ..... 3820184

[51] Int. Cl.[5] ..... B05G 11/10

[52] U.S. Cl. ..... 401/150; 222/321; 239/331

[58] Field of Search ..... 401/146, 150, 149; 222/321, 207, 341, 372; 239/331, 333

[56] References Cited

U.S. PATENT DOCUMENTS

| | | | |
|---|---|---|---|
| 3,036,327 | 5/1962 | Crawford | 401/150 X |
| 3,118,166 | 1/1964 | Bell | 401/150 X |
| 4,165,824 | 8/1979 | Sud | 222/341 |

FOREIGN PATENT DOCUMENTS 3608955 10/1987 Fed. Rep. of Germany .

*Primary Examiner*—Richard J. Johnson

*Attorney, Agent, or Firm*—Bachman & LaPointe

[57] ABSTRACT

An applicator device for a viscous material such as a cosmetic material comprises a metering pumping means for discharge of the material, in the form of a piston-cylinder unit arranged transversely with respect to the axis of the housing of the applicator device. The piston of the unit projects out of the housing of the applicator device, so that the piston is freely accessible from the outside.

3 Claims, 2 Drawing Sheets

APPLICATOR DEVICE FOR A VISCOUS MATERIAL

BACKGROUND OF THE INVENTION

An applicator device for applying a viscous material such as a cosmetic material, as disclosed in German Pat. No. 3 641 392, corresponding to U.S. Pat. No. , 4,810,124, which is hereby incorporated by reference herein, comprises an elongate housing with an applicator member and a metering pump means provided between an outlet opening of a container for accommodating the viscous material and an inlet opening of a duct for feeding the viscous material to an applicator member. The metering pump means has a displaceable piston in a housing portion acting as a cylinder. One of the cylinder chambers defined therein communicates by way of a check valve with the inlet opening, which is to be opened and closed by the piston, of the feed duct to the applicator member and also with the outlet opening of the container. The piston is resiliently biased towards its position of closing the inlet opening of the feed duct. It is in that position that the volume of the one cylinder chamber is at its largest. The piston-cylinder unit forming the metering pump means is arranged lengthwise relative to the axis of the applicator device and in its longitudinal direction the piston has a projection in the form of a thrust member. By way of inclined surfaces the thrust member co-operates with an actuating member which is movable transversely with respect to the longitudinal direction of the applicator device and which projects out of the housing so that it can be operated to apply material from the device.

That construction is comparatively expensive and the change in direction of the actuating force for the metering pump means through 90°, which is produced by virtue of the inclined surfaces, can give rise to problems in operation.

German laid-open application (DE-OS) No 36 08 955 Al concerns an applicator device in which a piston-cylinder unit is arranged transversely with respect to the longitudinal axis of the applicator device, with the piston, in its position of closing off the feed of material to the applicator member, projecting out of the housing of the device. However, that design is a basic one in which the metering effect depends on the length of time for which the piston actuating member is acted upon which is an undesirable dependency.

SUMMARY OF THE INVENTION

An object of the present invention is to provide an applicator device which can be actuated in a simple manner from the mechanical point of view.

Another object of the invention is to provide a cosmetic material applicator device in which the actuating force for producing discharge of the material from a container is applied in a rational fashion with respect to the configuration of the applicator device.

Still another object of the present invention is to provide a cosmetic material applicator device adapted to provide for more reliable actuation with a reduction in the level of frictional forces involved, while being of a simple and inexpensive construction.

In accordance with the present invention these and other objects are achieved by an applicator device for a viscous material such as a cosmetic material, comprising an elongate housing adapted to be connected to a container accommodating the viscous material, the housing including a feed duct for feeding material to an applicator member. Provided between the outlet opening of the container and the inlet opening of the feed duct for feeding the material to the applicator member is a metering pump means provided by a piston-cylinder unit comprising a housing portion acting as a cylinder and a displaceable piston in the housing portion. The piston-cylinder unit is arranged transversely with respect to the longitudinal axis of the applicator device. One of the cylinder chambers defined by the piston in its cylinder communicates with the inlet opening of the feed duct to the applicator member which is closed by the piston in a first position thereof. When the piston is in its first position, it projects out of the housing of the applicator device for access from the outside and thus forms an actuating member for the piston-cylinder unit. The above-mentioned one cylinder chamber also communicates with the outlet opening of the container by way of a check valve, while the piston is resiliently biased towards its first position of closing the inlet opening of the feed duct, in which position the volume of said one cylinder chamber is at its largest. Additionally, so that the piston is operable to close off the inlet opening to the feed duct in its first position, provided on the piston and on the housing portion acting as the cylinder are respective steps which on the one hand define the first position of the piston while on the other hand acting as a valve means in respect of the communication to the inlet opening of the feed duct, for a flow of viscous material to the applicator member, from the outlet opening of the container.

Further objects, features and advantages of the present invention will be apparent from the following description of a preferred embodiment thereof.

DESCRIPTION OF THE PREFERRED EMBODIMENT

Figure 1:
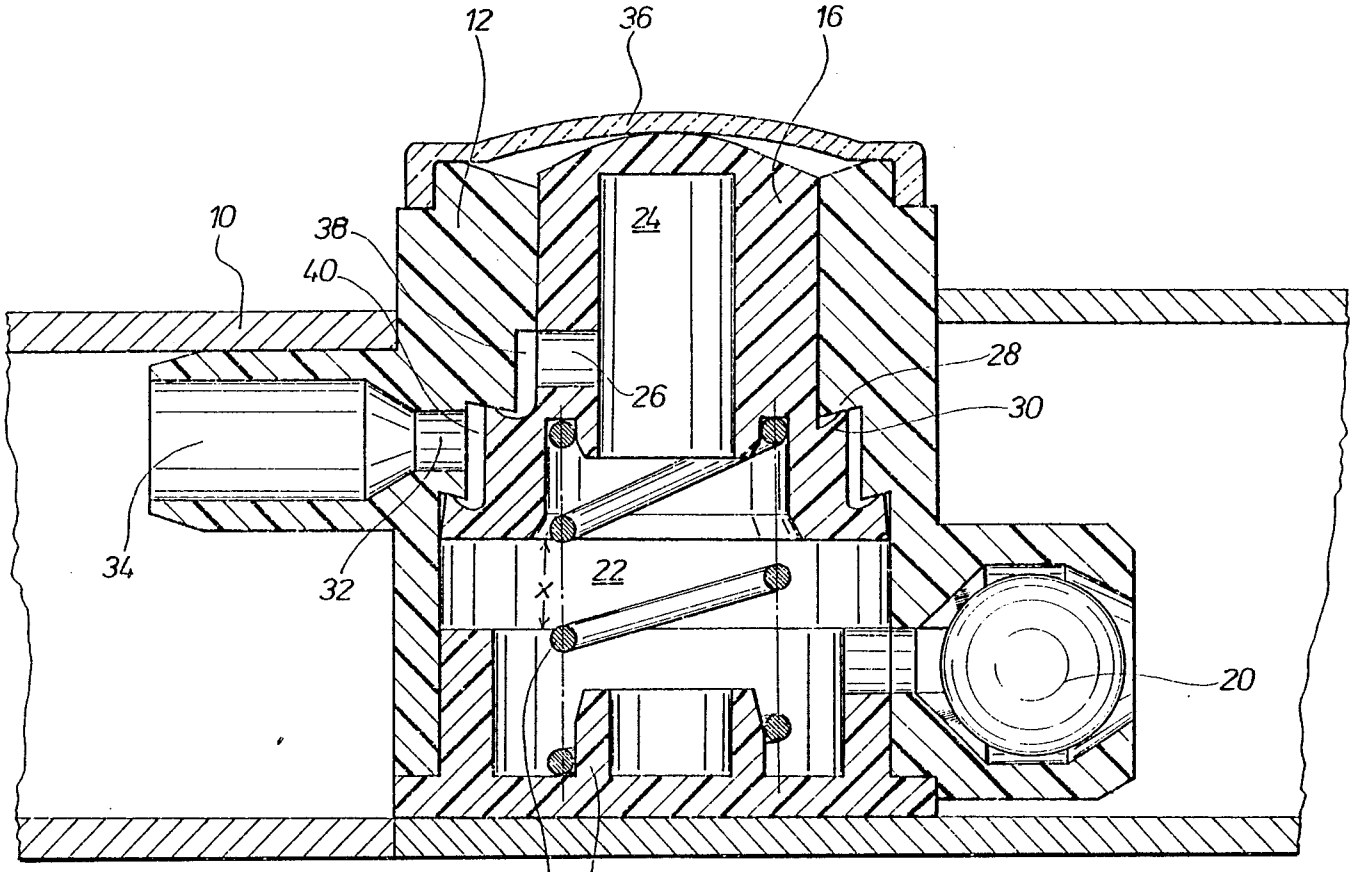
FIG. 1 is a view in longitudinal section of part of an applicator device according to the present invention, in the region of the metering pump means thereof.

Referring therefore now to the drawings, shown therein is part of an applicator device according to the invention illustrating a metering pump means thereof. The illustrated applicator device comprises an elongate housing which is indicated generally at 10 and which is adapted to be connected to a container 11 accommodating a viscous material such as a cosmetic material. The housing 10 accommodates a metering pump means in the form of a piston-cylinder unit comprising a two-part housing portion 12, and 14 acting as a cylinder, and a piston 16 slidably disposed in the cylinder 12, 14. The piston 16 is displaceable in the cylinder by a distance x and is urged by a coil spring 18 into an upper limit position which is established by means of the co-operation of a step 28 on the inside wall of the housing portion 12 and a step 30 on the outside wall of the piston 16, as can be seen from the drawings. In the lower limit the piston 16 bears against the lower housing portion 14 which projects into a cylinder chamber 22 defined within the cylinder beneath the piston 16.

Figure 2:
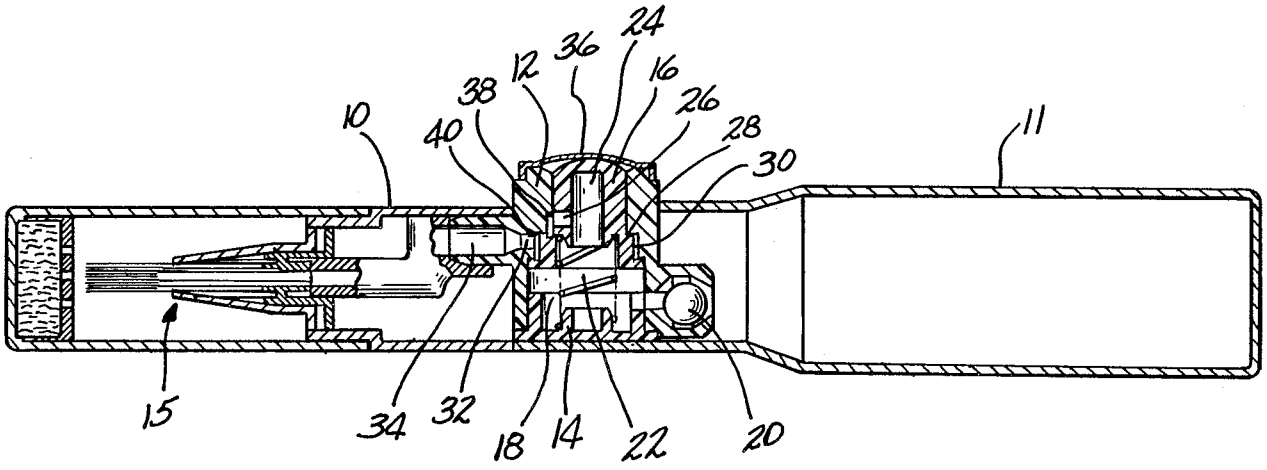
FIG. 2 is a cross sectional view of an applicator device incorporating the metering pump means of the present invention.

The container 11 for accommodating the viscous cosmetic material will be disposed on the right-hand side of the metering pump means as shown in FIG. 2. The outlet opening of the container communicates by way of a check valve 20 with the cylinder chamber 22 which is open towards a cavity 24 in the piston. The side wall of the piston 16 has a through bore 26 which extends transversely with respect to the direction of displacement of the piston 16 and which is closed in the upper limit position of the piston 16 by the cooperation of the steps 28 and 30 on the housing portion 12 and the piston 16, which thus bear against each other. When the piston 16 is urged towards its lower limit position, the step 30 on the piston 16 and the step 28 of the housing portion 12 move away from each other so that, as can be seen from the drawing, a passage is provided to an inlet opening 32 of a duct 34 for feeding the viscous cosmetic material to an applicator member 15 of the applicator device. To improve the flow of material through that passage, a groove 38 is provided in the housing portion 12 and an, enlargement bore 40 is provided beneath the step 28 of the housing portion 12.

As can be readily seen from the drawings, the check valve 20 opens when the piston 16 moves upwardly into its upper limit position because the volume of the cylinder chamber 22 increases and viscous cosmetic material is drawn thereinto from the container. In its upper limit position, the communication between the cylinder chamber 22 or the cavity 24 within the piston 16 and the inlet opening 32 to the feed duct 34 is interrupted by the steps 28 and 30 bearing against each other. When now the piston 16 is urged towards its lower limit position so that the volume of the cylinder chamber 22 is reduced, the check valve 20 positively closes and a communication is made between the cylinder chamber 22 and the inlet opening 32 of the feed duct 34 by virtue of the steps 28 and 30 being separated from each other, so that the material in the cylinder chamber 22 and in the cavity 24 within the piston is expelled in a metered fashion.

As will be apparent, the piston-cylinder unit 16, 22 is arranged transversely and more particularly perpendicularly to the longitudinal axis of the housing 10 and the piston 16 projects out of the housing 10 so that the piston 16 can be used directly as an actuating member.

The drawing also shows a flexible and preferably elastic rubber-type cover 36 which covers over the piston 16 and which is secured to the housing portion 12 to protect the sliding fit of the piston 16 in the housing portion 12. At the same time the cover 36 prevents the viscous material from escaping between the co-operating surfaces of the housing portion 12 and the piston 16.

It will be seen that the above-described construction provides that the force applied to the applicator device for the discharge of material therefrom is applied to the device in the same direction as the direction in which the piston is slidable in its cylinder to produce discharge of the material from the applicator member. There is therefore no longer any need for the actuating force . to be changed in direction through 90° and frictional forces involved in the mechanism illustrated are considerably reduced, in comparison with previous designs involving co-operation of inclined surfaces of actuating meters. Actuation of the illustrated construction is therefore generally more reliably while in addition the construction shown is simple and inexpensive.

It will be appreciated that the above-described construction in accordance with the principles of the present invention has been described solely by way of example and illustration thereof and that various alterations and modifications may be made therein without thereby departing from the spirit and scope of the invention.

What is claimed is:

1. An applicator device for a viscous material, comprising an elongate housing, duct means in the housing for connection to an outlet opening of a container accommodating the viscous material, a check valve associated with said duct means and operable to prevent a flow of material towards said container, an applicator member for application of the material, a feed duct in the housing for feeding material to the applicator member, metering pump means between said duct means and an inlet opening of said feed duct, said metering pump means comprising a piston-cylinder assembly having a housing portion acting as a cylinder and a piston slidable in the housing portion, the piston-cylinder assembly being disposed transversely with respect to the longitudinal axis of the housing, the piston defining in the cylinder a first cylinder chamber adapted to communicate with said inlet opening and with said duct means, means resiliently biasing said piston towards a position in said cylinder in which the volume of said first cylinder chamber is at its largest, the piston in said position projecting out of said housing so as to be accessible from the outside and thereby forming an actuating member for said metering pump means, and respective steps on said piston and said housing portion, the steps being co-operable with each other to define a limit position of said piston and operable as a closure valve means for interrupting communication between said first cylinder chamber and said inlet opening of said feed duct.

2. A device as set forth in claim 1 and further including a flexible cover over said piston to protect said position relative to the exterior.

3. An applicator device for a viscous material comprising: an elongate housing; connecting duct means in the housing adapted to be connected to an outlet opening of a container accommodating the viscous material to be applied by the device; check valve means operatively associated with said connecting duct means adapted to prevent a flow of said material towards said container; an applicator member connected to the housing for application of the material; feed duct means in said housing for feeding material to said applicator member; a metering pump means operatively disposed between said connecting duct means and said feed duct means and comprising a cylinder means and a piston slidable in said cylinder means, said piston defining first and second cylinder chambers in said cylinder means, said first chamber communicating with said connecting duct means and said second chamber communicating with said feed duct means, the piston and cylinder means being disposed transversely with respect to the longitudinal axis of the housing; passage means through said piston providing communication between said first and second cylinder chambers on one hand and said feed duct means on another hand; means resiliently biasing said piston in said cylinder towards a first position in which the volume of said first cylinder chamber is at its largest and in which said piston projects out of said housing so as to be accessible from the outside, said piston in said first position forming an actuating member for said metering pump means; respective steps on said piston and in said cylinder; said steps being adapted to co-operate with each other to define said first position of said piston; and said steps being in mutual contact adapted to close said communication between said first cylinder chamber and said feed duct means when said piston is in said first position.

* * * * *